US005647537A

United States Patent [19]

Bergmann

[11] Patent Number: 5,647,537

[45] Date of Patent: Jul. 15, 1997

[54] MULTIFUNCTION SHOWER HEAD

[75] Inventor: Konrad Bergmann, Mosel, Germany

[73] Assignee: Ideal-Standard GmbH, Bonn, Germany

[21] Appl. No.: 433,357

[22] PCT Filed: Oct. 23, 1993

[86] PCT No.: PCT/EP93/02935

§ 371 Date: May 2, 1995

§ 102(e) Date: May 2, 1995

[87] PCT Pub. No.: WO94/11112

PCT Pub. Date: May 26, 1994

[30] Foreign Application Priority Data

Nov. 9, 1992 [AT] Austria ..... 2204/92

[51] Int. Cl.[6] ..... B05B 1/34

[52] U.S. Cl. ..... 239/383; 239/394; 239/447

[58] Field of Search ..... 239/380–383, 239/537–539, 390, 391, 392, 394, 436, 443, 444, 446, 447

[56] References Cited

U.S. PATENT DOCUMENTS

| | | | |
|---|---|---|---|
| 3,963,179 | 6/1976 | Tomaro | 239/381 X |
| 4,081,135 | 3/1978 | Tomaro | 239/447 X |
| 4,203,550 | 5/1980 | On | 239/383 |
| 4,204,646 | 5/1980 | Shames et al. | 239/443 |
| 4,588,130 | 5/1986 | Trenary et al. | 239/381 |
| 5,201,468 | 4/1993 | Freier et al. | 239/383 |
| 5,356,077 | 10/1994 | Shames et al. | 239/383 |
| 5,467,927 | 11/1995 | Lee | 239/383 |

FOREIGN PATENT DOCUMENTS

| | | | |
|---|---|---|---|
| 461089 | 12/1991 | European Pat. Off. | 239/381 |
| 2753857 | 6/1978 | Germany . | |
| 3736975 | 4/1989 | Germany . | |
| 4109001 | 9/1992 | Germany | 239/381 |
| 2121319 | 12/1983 | United Kingdom . | |

*Primary Examiner*—Lesley D. Morris
*Attorney, Agent, or Firm*—Herbert Dubno

[57] ABSTRACT

A multifunction shower head with a housing, a fixed nozzle plate, and a rotatable nozzle shutter in which is set a screen disk and which is fixed to an adjustment ring has between the housing and the nozzle plate a guide plate with through-going passages and a wheel with radially extending and annularly arranged vanes, apertured regions and blocking regions. Rotation of the nozzle shutter relative to the nozzle plate and arresting or releasing of the wheel allows several types of spray to be selected.

5 Claims, 6 Drawing Sheets

MULTIFUNCTION SHOWER HEAD

CROSS REFERENCE TO RELATED APPLICATIONS

This is a national phase of PCT/EP93/02935 filed Oct. 23, 1993 and based, in turn, on Austrian application A 2204/92 filed Nov. 9, 1992 under the International Convention.

FIELD OF THE INVENTION

The invention relates to a multifunction shower head with a housing, a fixed nozzle plate, and a rotatable nozzle shutter in which is set a screen disk and which is fixed to an adjustment ring.

BACKGROUND OF THE INVENTION

Shower fixtures of high quality nowadays have, among other things, the capacity of being set to produce different sprays from the shower head. In this manner the strength of the water spray and the amount of admixed air can be set and a massage effect can be achieved.

With the hitherto known shower heads of this type the different types of spray are produced by several nozzle plates which are shifted relative to each other. The disadvantage of this is the large bulk caused by the complicated construction and the different number of jets with different functions. This is in particular true for shower heads that are capable of pulsating operation. Mainly the individual functions are taken care of by different regions in the closing shutter of the shower head, that is the entire surface of the closing shutter is never used.

OBJECTS OF THE INVENTION

It is an object of the invention to provide a shower head that can be set for several sprays, in particular with at least one pulsating spray, and which does not have the above-described disadvantages.

This object is attained in that between the housing and the nozzle plate there is provided a guide plate with throughgoing passages and a wheel with radially extending and annularly arranged vanes, apertured regions, and blocking regions. The water is directed by the throughgoing passages to the wheel to set it in rotation. The apertured regions and the blocking regions of the wheel rapidly cover and uncover the underlying openings of the nozzle plate as the wheel rotates so that a pulsating spray is produced. Rotating the nozzle shutter relative to the nozzle plate can also change the water spray.

The throughgoing passages in the guide plate extend skew between inlet openings on the outer face turned toward the housing and angularly offset outlet openings on the outer face turned toward the wheel so the flow direction of the water streams exiting the throughgoing passages already have a tangential component relative to the wheel and thus ensure its rotation.

Advantageously the multifunction shower head can also have several types of spray without pulsation. To this end a lift ring is provided between the screen disk and the nozzle plate which is provided on one side with angled projections which slide on an annular collar of the nozzle plate provided with steps and which is provided on the other side with pins for arresting the wheel in a raised position of the lift ring, that is when the angled projections are on the steps of the annular collar. Rotation of the nozzle shutter relative to the lift ring moves the angled projections on the lift ring into a lowered position, that is between the steps to free the wheel to form a pulsating spray, or into a raised position, that is on the steps, to arrest the wheel and produce a continuous water spray. Further rotation can, e.g., admix air. Both the pulsating and the continuous water spray is distributed over the entire nozzle shutter surface.

Preferably the pins of the lift ring extend through the nozzle plate and engage in the raised position of the lift ring against the wheel and lift it, the opposite surface of the wheel being formed with a ring of teeth which engage in a ring of teeth provided on the guide plate. The spacing between the wheel and the nozzle plate is in this case increased by lifting the wheel to make possible a uniform throughflow of the nozzle plate even in the regions under the covered regions of the wheel.

The lift ring has radial elastic projections whose outer ends engage the nozzle plate and which are elastically deformed in the raised position. In this manner on return to the lowered position of the lift ring there is a return force which pulls back the pins and thereby lowers and frees the wheel.

To guide the nozzle plate when it rotates relative to the nozzle shutter, the nozzle plate has on its outer periphery a guide projection which rides in a recess in the nozzle shutter and an elastically secured locking projection which engages in seats in the nozzle plate. This facilitates use of the shower head and prevents an unintentional changing of the set position.

BRIEF DESCRIPTION OF THE DRAWING

The above and other objects, features and advantages will become more readily apparent from the following description, references being made to the below-identified drawing.

Figure 1F:
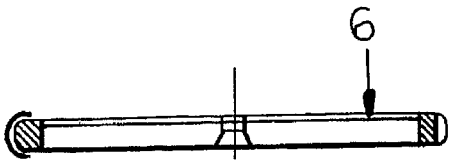
FIG. 1F is a top view of an adjustment ring.
Figure 1E:
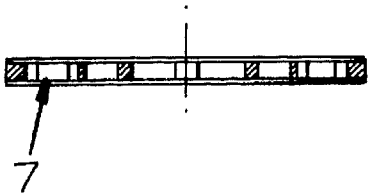
FIG. 1E is a cross-sectional view of the screen disk.
Figure 1C:
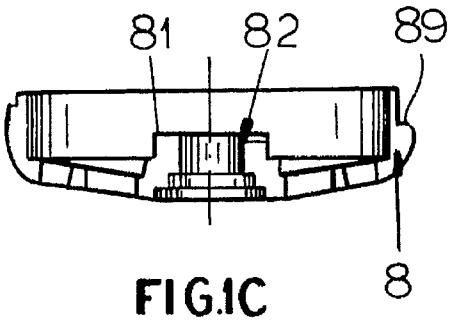
FIG. 1C is a cross-sectional view of the shutter shown in FIG. 1B.
Figure 1B:
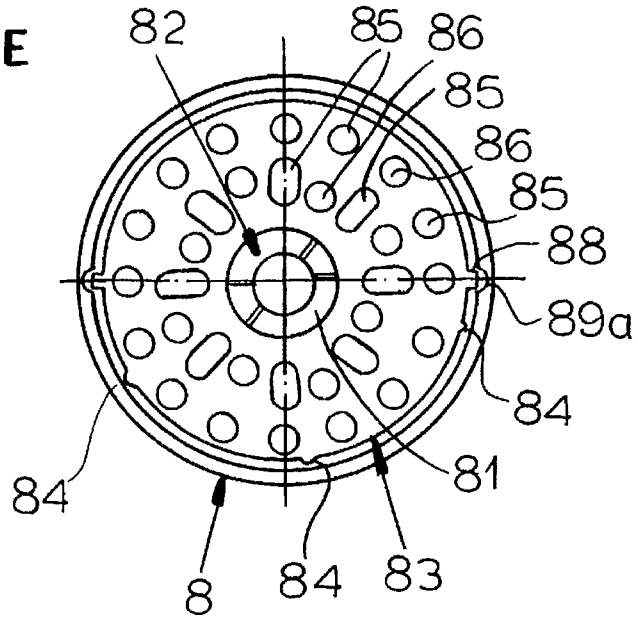
FIG. 1B is a top view of a shutter.
Figure 1A:
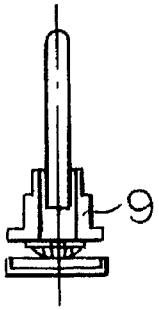
FIG. 1A is a cross-sectional view of a regulating screw.
Figure 1D:
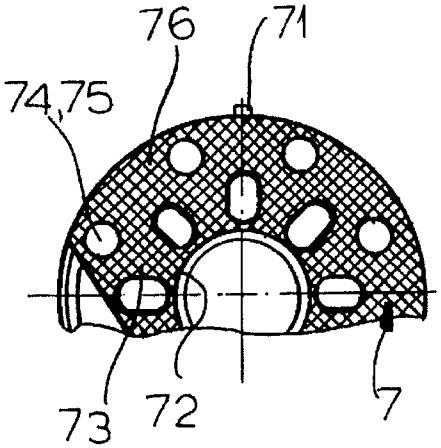
FIG. 1D is a top view of a screen disk.
Figure 1J:
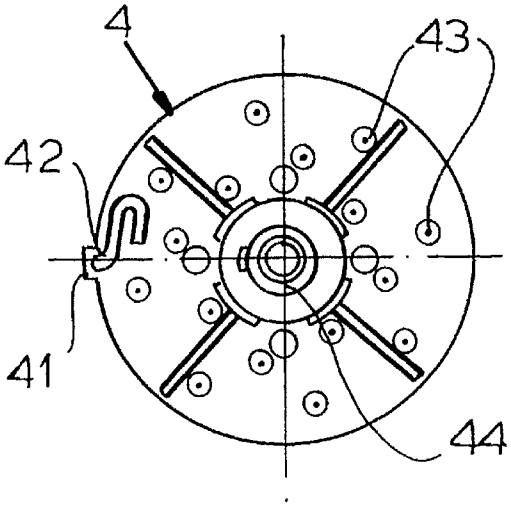
FIG. 1J is a top view of a nozzle plate.
Figure 1H:
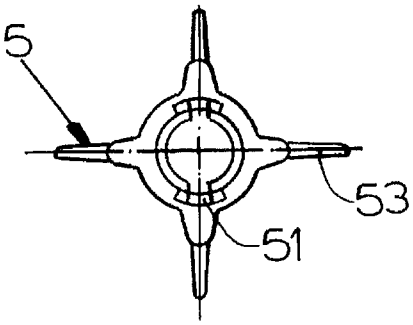
FIG. 1H is top view of a lift ring.
Figure 1Q:
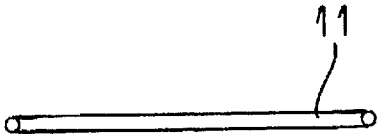
FIG. 1G is cross-sectional view of the ring seen in FIG. 1F.
FIG. 1I is a cross-sectional view of the lift ring.
FIG. 1K is a cross-sectional view of the nozzle plate.
FIG. 1L is a top view of a wheel.
FIG. 1M is a cross-sectional view of the wheel seen in FIG. 1L.
Figure 1K:
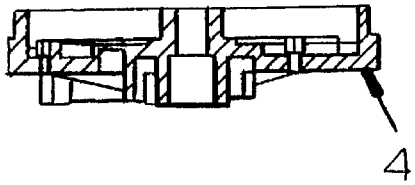
Figure 1I:
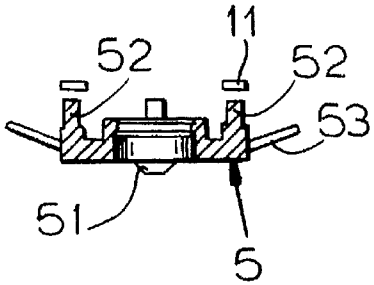
Figure 1G:
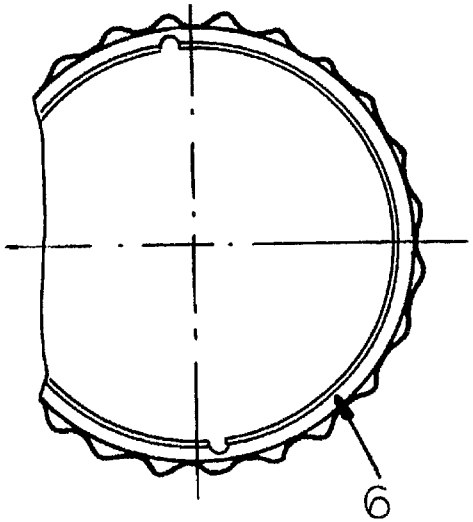
Figure 1N:
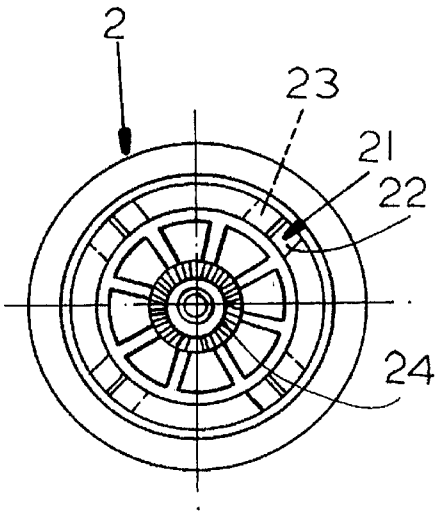
Figure 1P:
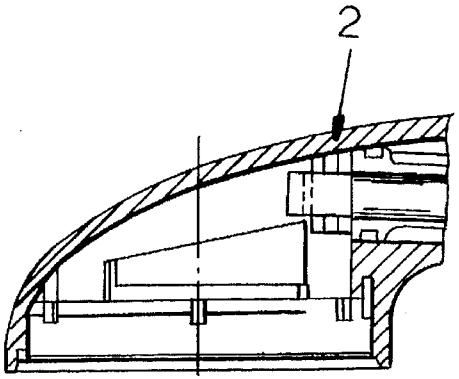
Figure 1O:
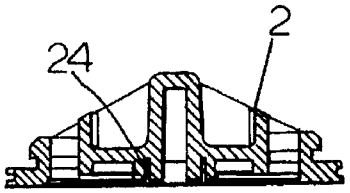
Figure 1M:
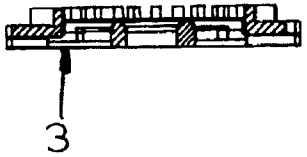
Figure 1L:
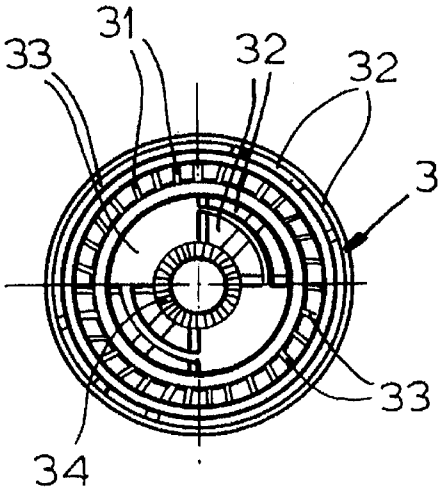

FIG. IN is a top view of a guide plate;

FIG. 1O is a cross-sectional view of the guide plate; and

FIG. 1P is cross-sectional view of a housing; and

FIG. 1Q is a sealing "O" ring

Figure 2:
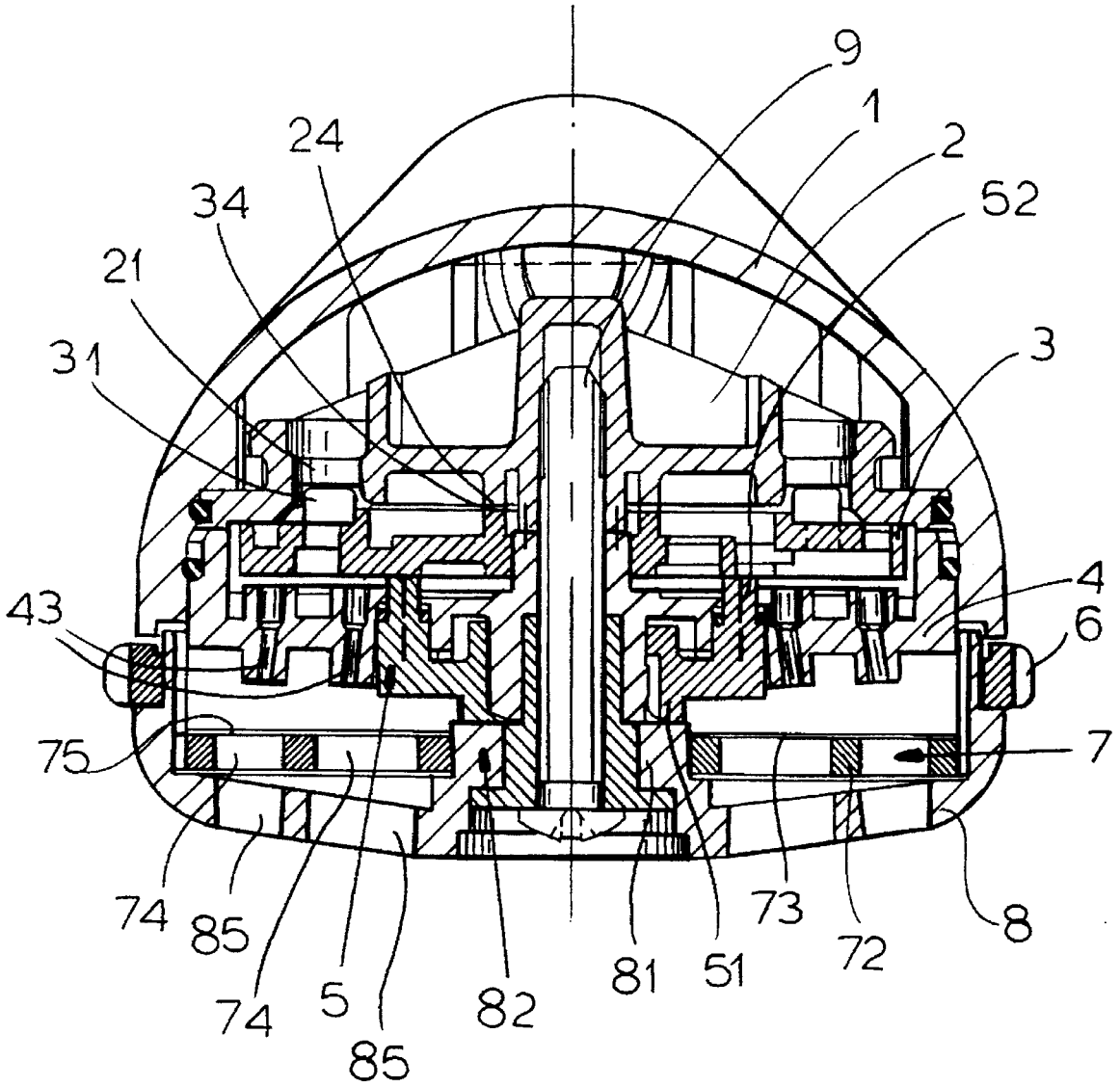
Figure 3:
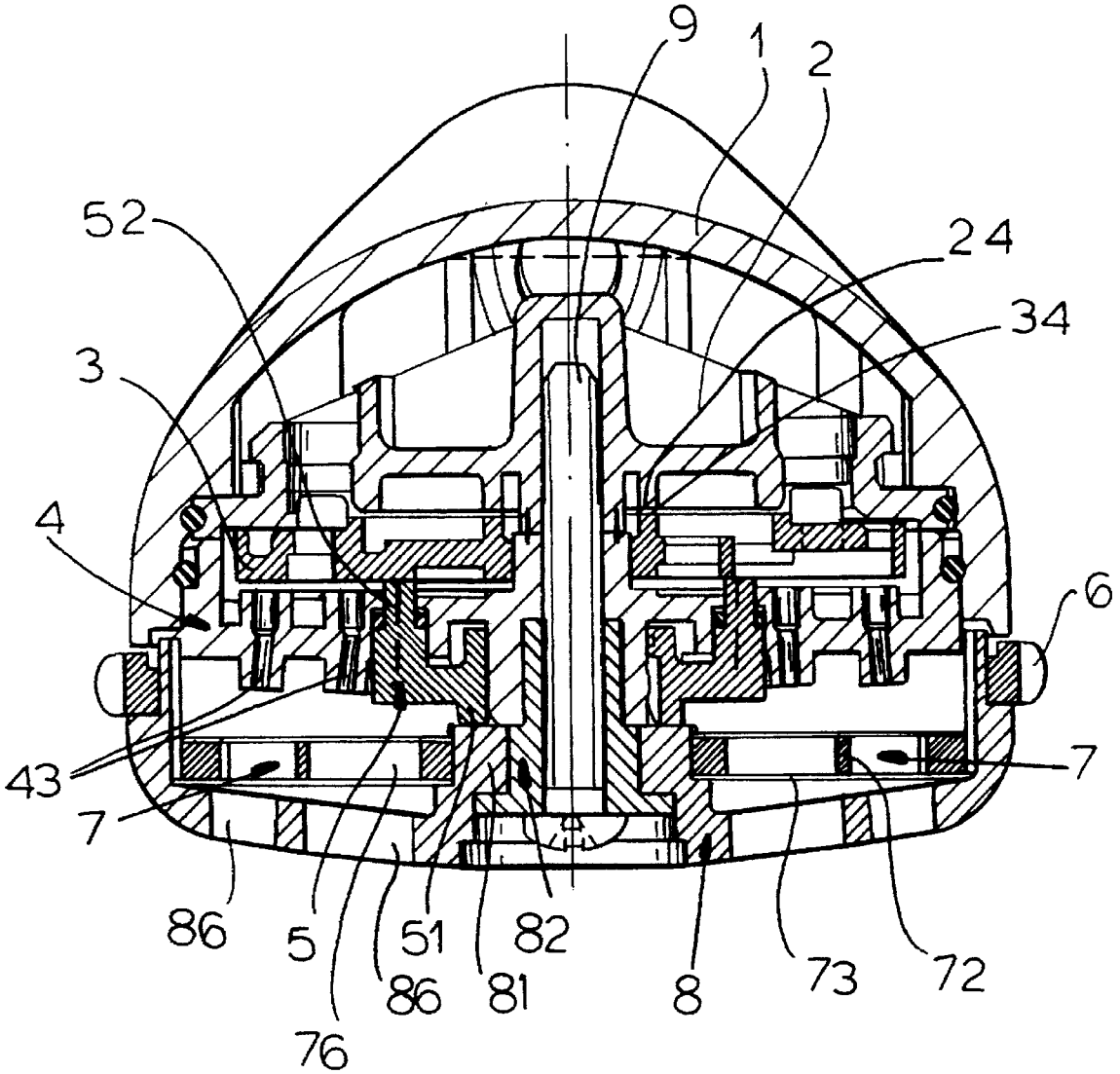
Figure 4:
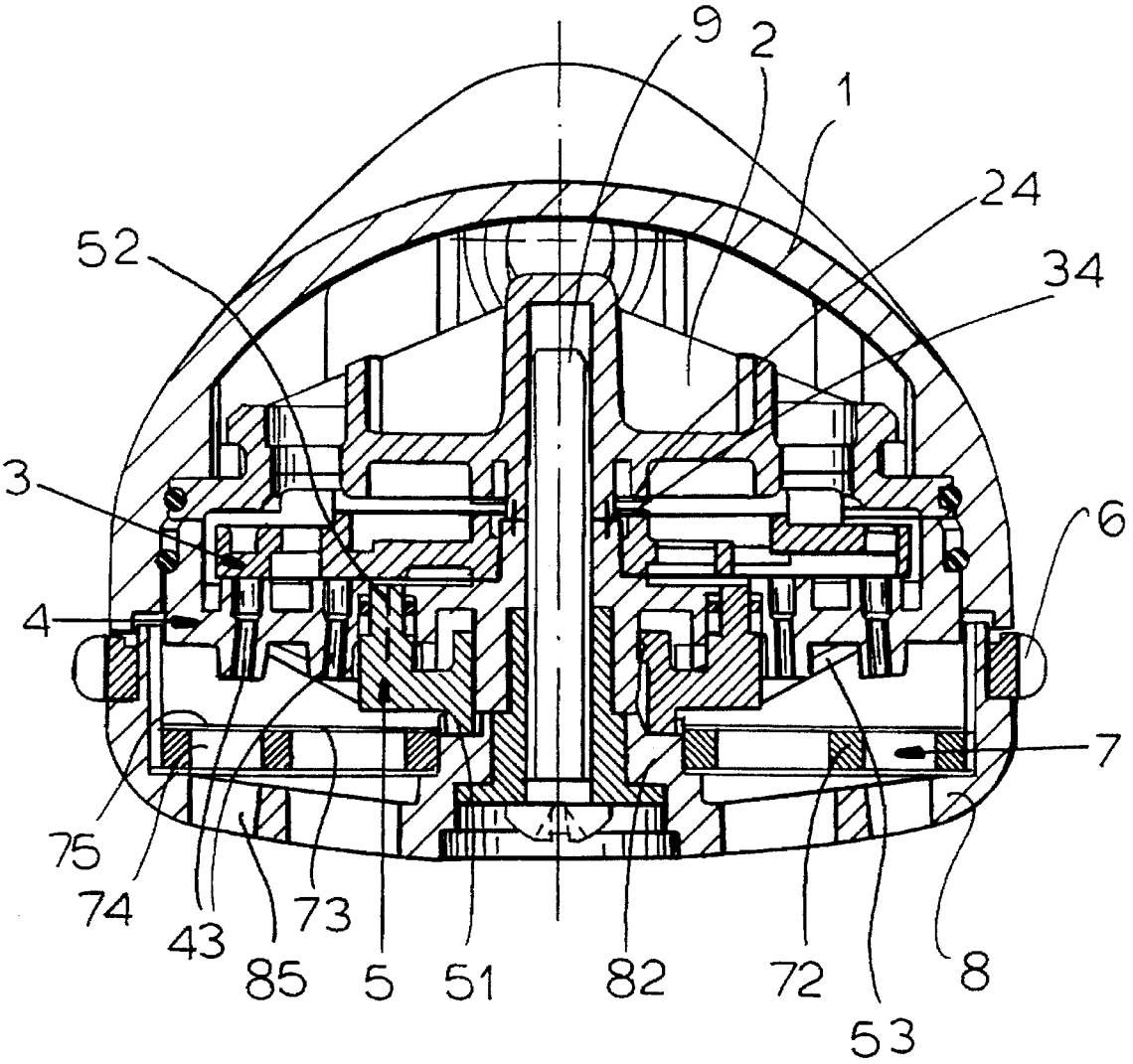

FIGS. 2 through 4 show the shower head in section in the various positions, "needle spray," "soft spray," and "pulsing massage spray."

As can be seen in FIG. 1 the shower head has a nozzle shutter 8 (shown in section and top view from above) with a plurality of nozzle apertures 85 and 86 of different shape. An annular collar 82 projecting toward the housing 1 around a central bore 87 has regions of different heights and the portions of greater height, hereinafter called steps, are identified with reference 81. Surrounding the annular collar 82 in the nozzle shutter 8 is a screen disk 7 which is formed on its outer periphery with one or more bumps 71 which engage in grooves 88 in the nozzle shutter 8 in order to prevent rotation of the screen disk 7 relative to the nozzle shutter 8. The screen disk 7 is formed of a base disk 72 which is preferably covered on both faces with a screen 73. The base disk 72 has throughgoing holes 74 which are partially aligned with the nozzle apertures 85 in the nozzle shutter 8 and which are aligned by corresponding coutouts 75 of the screen 73. Other throughgoing holes 76 in the base disk 72 on the other hand are covered by the screen 73. An adjustment ring 6 is set on the step 89 of the nozzle shutter 8, bumps 89*a* on this nozzle shutter 8 engaging in grooves 61 of the adjustment ring 6 in order to prevent relative rotation of the nozzle shutter 8 and adjustment ring 6.

In addition the shower head has a nozzle plate (shown in section and in a bottom view) with openings 43 which according to the angular position of the nozzle plate 4 relative to the nozzle shutter 8 with the inset screen disk 7 are aligned either with the nozzle apertures 85 and the holes 75 (needle-spray position of FIG. 2 and massage position of FIG. 4) or with the apertures 86 covered by the screen (soft-spray position of FIG. 3). In no position are any of the holes 43 covered by the nozzle shutter 8 or the base disk 72 so that the number of streams in any position are the same. The nozzle plate 4 has at one location along its outer periphery a guide bump 41 which is guided in a recess 83 in the nozzle shutter 8 on rotation of same relative to the nozzle plate 4.

The nozzle shutter 8 is provided at both ends and in the middle of the recess 83 with seats 84 in which a latching projection 42 of the nozzle plate 4 can engage in order to hold it in the position of the selected function. On the side of the nozzle shutter 8 turned away from the nozzle plate 4 a wheel 3 is set in the nozzle plate 4. This wheel 3 (seen in section and in top view) rides on an annular raised portion 44 of the nozzle plate and has radially extending and annularly arranged vanes 31, apertured regions 32, and blocking regions 33. Water striking the vanes 31 sets the wheel in rotation so that the blocking regions 32 and the apertured regions 33 rapidly succeed one another in covering and uncovering the openings 43 of the nozzle plate 4. A guide plate 2 provided above the wheel 3 has throughgoing passages 21 whose inlet ends 22 and outlet ends 23 are offset from one another angularly. The water flowing through these passages 21 thus engages the radial vanes 31 at an angle and thus ensures rotation of the wheel 3.

Between the screen disk 7 or the nozzle shutter 8 and the nozzle plate 4 is a lift ring 5 which has on its side turned toward the nozzle shutter 8 two angled projections 51 which run on the annular collar 82 of the nozzle shutter 8. On its other side the lift ring 5 has four pins 52 which pass through the nozzle plate 4. Furthermore there are on the lift ring 5 four radially extending elastic projections 53 whose ends bear on the nozzle plate 4. According to the position of the nozzle shutter 8 relative to the lift ring 5 these projections 51 are on the steps 81 of the annular collar 82 and the lift ring 5 is in the raised position or the projections 51 are between the steps 81 and the lift ring 5 is in the lowered position. In the raised position the lift ring 5 is pressed with elastic deformation of its extensions 53 against the nozzle plate 4 and the pins 52 project past the face of the wheel 3 turned away from the nozzle plate 4, engage on the wheel 3, and lift it. The wheel 3 has on its side turned toward the guide plate 2 a ring of teeth 34 which when lifted engage in a ring of teeth 24 in the guide plate 2. Thus rotation of the wheel 3 is blocked. Lifting the wheel 3 increases the space between the wheel 3 and the nozzle plate 4 so that all the openings 43 of the nozzle plate 4, even those covered by the blocking regions 33 of the wheel 3, are uniformly traversed. Rotation of the nozzle shutter 8 brings the lift ring 5 again into the lowered position with the elastic projections 58 producing the necessary return force in order to withdraw the pins 52 and push the angled projection 51 of the lift ring 5 into the region between the steps 81 on the annular collar 82. A screw 9 passes through the nozzle shutter 8, the lift ring 5, the nozzle plate 4, and the wheel 3 and is seated in a screwthread in the guide plate 2. The thus interfitted insert is set in the housing. Several O-rings 11 serve for sealing the shower head.

FIG. 2 shows the shower head in the needle-spray position. The nozzle plate is situated relative to the nozzle shutter 8 and the screen disk 7 such that the streams of water coming out of the openings 43 flow through the cutouts 75 in the disk 73, the holes 74 of the base disk 72, and the nozzle holes 85 of the nozzle shutter 8. The angled projections 51 of the lift ring 5 are on the steps 81 of the annular collar 82 of the nozzle shutter 8, that is the lift ring is in the raised position, and the pins 52 of the lift ring 5 engage the wheel 3 and lift it. The teeth 34 of the wheel 4 engage in the teeth 24 of the guide plate 2 so that the wheel 4 is arrested. The produced water spray does not pulsate.

FIG. 3 shows the shower head in the soft-spray position. The nozzle plate 4 is so positioned relative to the nozzle shutter and the screen disk 7 that the water streams come out of the openings 43 through the holes 76 of the base disk 72 that are covered by the screen 73 and then through the holes 86 of the nozzle shutter 8. The angled projections 51 of the lift ring 5 are also in this position on the steps 81 of the annular collar 82 of the nozzle shutter 8, that is the lift ring is in the raised position and the pins 52 of the lift ring 5 engage the wheel 3 and lift it. The teeth 34 of the wheel 3 engage in the teeth 24 of the guide plate 2 so that the wheel 3 is arrested. The produced water spray is not pulsating and is mixed with air.

FIG. 4 shows the shower head in the position with a pulsating massage spray. The nozzle plate 4 is positioned with respect to the nozzle shutter 8 and the screen disk 7 such tat the water streams come out of the openings 43 and through the cutouts in the disk 73, the holes 74 of the base disk 72 and the nozzle apertures 85 in the nozzle shutter 8. The angled projections 51 of the lift ring 5 are between the steps 81 of the annular collar 82 of the nozzle shutter 8, that is the lift ring is in the lowered position and the pins 52 of the lift ring 5 are recessed into the nozzle plate 4. There is a gap between the wheel 3 and the pins 52 and the wheel 3 is lower than in FIGS. 2 and 3 so that the teeth 34 of the wheel 4 do not engage in the teeth 24 of the guide plate 2 and the wheel 3 can rotate freely. The produced water spray is pulsing.

I claim:

1. A multifunction shower head comprising:

a housing having an inlet and an outlet side having an axis whereby water flows along an axis from said housing;

a nozzle shutter mounted rotatably on said housing at said outlet side to form a bottom thereof and being provided with:

a peripheral surface centered on said axis;

jet means forming water jet outlets, and a step-like inner annular collar extending axially toward said inlet and equidistantly spaced radially inwardly from said peripheral surface of said nozzle shutter;

a screen disc coaxial with said nozzle shutter and mounted on and extending radially outwardly from said collar;

an adjustment ring mounted on said peripheral surface of said shutter and coaxially therewith upstream from said jet means to prevent relative rotation of the nozzle shutter and screen disc; a perforated nozzle plate mounted rotatably fixed on said shutter and spaced upstream from said screen disc;

a wheel mounted rotatably between said inlet of the housing and nozzle plate and coaxial therewith and formed with:

radially extending and annularly arranged vanes, and a plurality of apertured and blocking regions;

a perforated guide plate between said inlet and said wheel and coaxial therewith and mounted fixed on said housing; and a lift ring coaxial with said screen disc and mounted between said screen disc and said nozzle plate, said lift ring being axially displaceable between a lower position and an upper position and being provided with:

angled projections extending axially toward screen disc to slidably engage said annular collar of said nozzle shutter in the lower axial position of said lift ring, and a plurality of pins extending axially toward said wheel and pressing thereagainst upon displacing said lift ring in the upper position thereof to arrest rotation of said wheel.

2. The multifunction shower head defined in claim 1 wherein said perforated guide plate is formed with a plurality of thoroughgoing passages extending skew between respective inlets openings formed on an upstream face and angularly offset outlet openings on a downstream face of said guide plate.

3. The multifunction shower head defined in claim 1 wherein said plurality of pins extend through said nozzle plate and press against said wheel to axially displace said wheel toward and press against said guide, said guide plate and said wheel being formed with respective axially oppositely extending meshing teeth, so that rotation of said wheel is arrested upon meshing.

4. The multifunction shower head defined in claim 1 wherein said lift ring is further formed with radial elastic projections formed in an upstream face thereof, said projections engaging the nozzle plate to be elastically deformed in the upper position of said lift ring.

5. The multifunction shower head define in claim 1 wherein said peripheral surface of nozzle shutter is formed with:

a peripheral recess, and a plurality of angularly spaced seats, said nozzle plate being formed with a respective periphery having:

a guide projecting axially toward and engaging said peripheral recess for relative rotation of said plate with respect to said shutter, and a locking projection extending radially outwardly and engaging a respective one of said seats to secure an angular position of said guide plate relative to said shutter.

* * * * *